United States Patent [19]

Ikeda et al.

[11] 4,324,967

[45] Apr. 13, 1982

[54] MICROWAVE HEATING APPARATUS HAVING MAGNETIC COUPLING FOR DRIVING THE ANTENNA

[75] Inventors: Nobuo Ikeda; Hirofumi Yoshimura, both of Nara, Japan

[73] Assignee: Matsushita Electric Industrial Co., Ltd., Osaka, Japan

[21] Appl. No.: 184,322

[22] Filed: Sep. 5, 1980

Related U.S. Application Data

[63] Continuation of Ser. No. 57,676, Jul. 16, 1979, abandoned.

[30] Foreign Application Priority Data

Jul. 18, 1978 [JP] Japan ..... 53-88194

[51] Int. Cl.[3] ..... H05B 6/72

[52] U.S. Cl. ..... 219/10.55 F

[58] Field of Search ..... 219/10.55 F, 10.55 R

[56] References Cited

U.S. PATENT DOCUMENTS 2,520,602 8/1950 Linder ..... 219/10.55 F X
3,643,055 2/1972 Suzuki et al. ..... 219/10.55 F
4,092,512 5/1978 Suzuki et al. ..... 219/10.55 F

FOREIGN PATENT DOCUMENTS 2622173 12/1976 Fed. Rep. of Germany ... 219/10.55 F
2844128 4/1979 Fed. Rep. of Germany ... 219/10.55 F

*Primary Examiner*—B. A. Reynolds
*Assistant Examiner*—Philip H. Leung
*Attorney, Agent, or Firm*—Wenderoth, Lind & Ponack

[57] ABSTRACT

A microwave heating apparatus with a heating chamber, a high frequency oscillator, and a wave guide between the oscillator and the chamber has a rotatable antenna coupling the wave guide with the heating chamber for distributing high frequency radiation in the chamber. The rotatable antenna has an inner end extending into the wave guide and which is rotatably mounted therein, a first magnet is provided in the inner end of the rotatable antenna, and an antenna drive motor located outside the wave guide has a second magnet in spaced opposed relation to the first magnet and forming a magnetic coupling therewith.

2 Claims, 3 Drawing Figures

MICROWAVE HEATING APPARATUS HAVING MAGNETIC COUPLING FOR DRIVING THE ANTENNA

The present application is a continuation of application Ser. No. 057,676, filed July 16, 1979 now abandoned.

This invention relates to a microwave heating apparatus of the type wherein high frequency radiation is supplied to a heating chamber by a rotatable antenna, and more particularly relates to a simply constructed high-performance rotatable antenna and a means for driving it which smooths the rotation of the antenna and keeps the relationship between the rotatable antenna and the heating chamber constant at all times.

BACKGROUND OF THE INVENTION AND PRIOR ART

While in the past several proposals have been made providing a rotatable antenna in a microwave heating apparatus, few products have been in fact provided with such an antenna. To date no commercial products which have such a rotatable antenna have been marketed in Japan or in other countries.

In a typical microwave heating apparatus which has been proposed heretofore, there is provided a bent antenna having the inner end connected by a pin to a driving shaft within a wave guide, and the driving shaft is in turn connected to a driving gear by a pin and is also mounted in a bearing in the wall of the wave guide. In this structure the inner end of the antenna and the driving shaft may not be properly aligned and the tolerances at the various bearings and connections may be such that taken together they permit the position of the outer end of the antenna to be at different distances from the heating chamber wall during antenna rotation, thereby causing uneven distribution of the radiation.

OBJECT AND BRIEF SUMMARY OF THE INVENTION

It is the object of the present invention to provide a simplified antenna and driving structure which overcomes the drawbacks of the prior art structure. To this end the present invention provides a microwave heating apparatus comprising: a heating chamber; a high frequency oscillator; a wave guide between said oscillator and said chamber for leading electric radiation from said oscillator to said chamber; a rotatable antenna coupling said wave guide with said heating chamber for distributing high frequency radiation in said chamber, said wave guide and said rotatable antenna being made of non-magnetic material, said rotatable antenna having an inner end extending into said wave guide and which is rotatably mounted therein; a first magnetic in the inner end of said rotatable antenna; an antenna drive means outside said wave guide; and a second magnet on said drive means outside said wave guide and in spaced opposed relation to said first magnet and forming a magnetic coupling therewith. The first magnet preferably has a pointed tip thereon engaging the wall of the wave guide between said first and second magnets, and the wave guide has a sleeve bearing therein in which the inner end of said antenna is rotatably mounted. The inner end of said antenna preferably has an outwardly extending flange thereon engaging the inner end of said sleeve bearing when said pointed tip engages the waveguide.

DETAILED DESCRIPTION OF THE INVENTION

Figure 1:
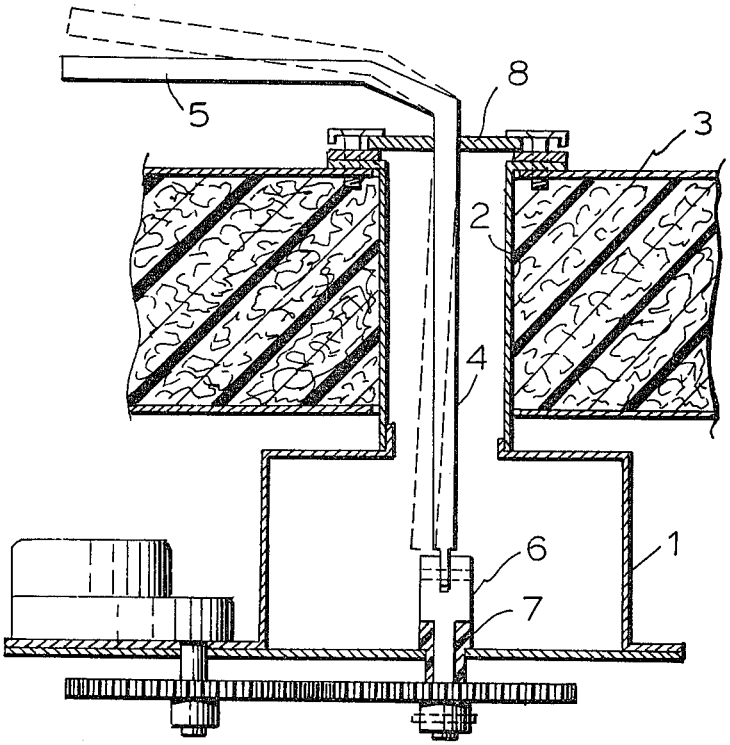
(PRIOR ART) FIG. 1
FIG. 1 is a partial cross sectional view of the essential parts of a prior art rotatable antenna structure.
Figure 2:
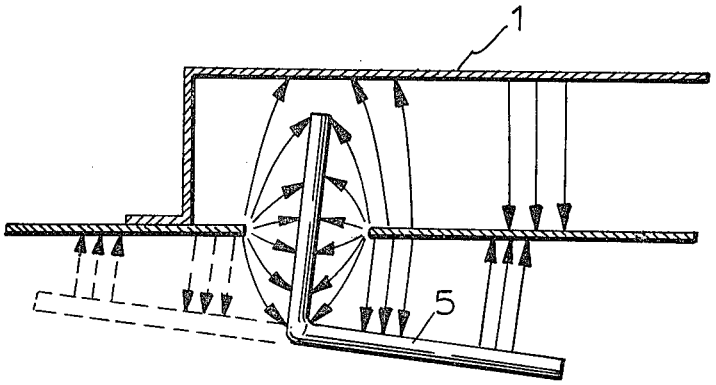
(PRIOR ART) FIG. 2
FIG. 2 is a diagram for explaining the performance drawbacks of the prior art structure.

A typical example of a microwave heating apparatus according to the prior art is shown in FIG. 1 and comprises a wave guide 1 for transmitting high frequency radiation from a generator, and outer conductor 2 of a coaxial cable connecting the wave guide 1 to a heating chamber, an inner end 4 of an antenna constituting the inner conductor of the coaxial cable, the antenna having an outer end 5 bent approximately 90° relative to the inner end and located within the heating chamber. The inner end 4 is pin-connected to a driving shaft 6 within the wave guide 1, which shaft in turn is pin-connected to a driving gear outside the wave guide and which is mounted in a bearing 7 extending through the wall of the wave guide. A cover 8 prevents food debris or the like in the heating chamber from entering the coaxial cable and the wave guide 1 and also serves as another bearing for the rotating antenna 5. As pointed out above, the major shortcoming of the above described structure is the possibility that the inner end of the antenna and the shaft may not be in proper alignment. This is because one bearing is secured to the wall of the heating chamber and the other bearing is secured to the wave guide which is not secured directly to the wall of the heating chamber. Moreover the tolerances in the connections between the driving means and the antenna may be too great for good alignment. In other words, if the gap between the wave guide wall and the bearing 7, the gap between the bearing 7 and the driving shaft 6 and the gap between the driving shaft 6 and the inner end 4 are all added up, then a substantial gap will exist in the overall connection. Accordingly, even if the centers of the two bearings are properly aligned, the antenna may be inclined, as shown in the broken lines, if it contacts the foodstuff. If the antenna is inclined, the spacing between the outer end 5 of the antenna and the heating chamber wall will vary during rotation of the antenna as seen in FIG. 2. If the spacing between the antenna and the heating chamber wall is greater than normal, high frequency radiation from the antenna will increase correspondingly. On the contrary if the spacing is less, the space between the antenna and the heating chamber wall will further function as a transmission line with a resulting reduction in transmission of radiation energy to the interior of the heating chamber. Therefore, if the antenna is inclined, heating is increased on one side of the chamber and reduced on the opposite side. Although the rotatable antenna is provided for the purpose of improving microwave energy distribution this inclining of the antenna may result in an adverse effect rather than accomplishing the intended effect.

It is very important when using a rotatable antenna that the driving shaft and the portion of the antenna to which it is connected for driving be held perpendicular to the wall and the spacing between the outer end of the antenna and the chamber wall be constant at all times.

Figure 3:
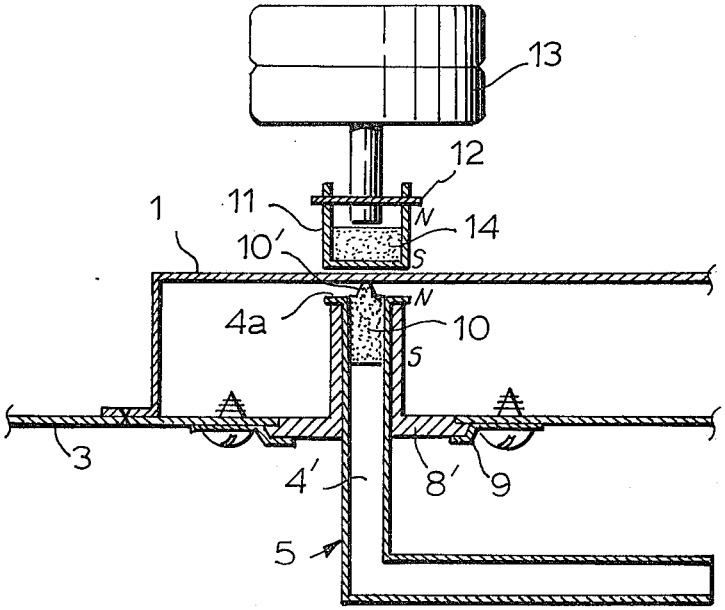
FIG. 3 is a partial cross sectional view of one preferred form of the microwave heating apparatus having the rotatable antenna according to the present invention.

One preferred form of the present invention which achieves this will now be described with reference to FIG. 3. As shown in this figure, a wave guide 1 made of non-magnetic material such as stainless steel or the like is attached directly to the wall 3 of a heating chamber, for example by conventional spot welding. An antenna 5' is a hollow tube made of non-magnetic material with arms bent at a right angle and having an inner end 4' journaled in a sleeve bearing 8' secured in an opening in the heating chamber wall by a holder 9. A first magnet 10 is mounted inside the end of the inner end 4 of the rotatable antenna 5' which is within the wave guide. Although an extremely high electric field is present around the first magnet 10, the magnet is enclosed in the metallic antenna 5' and thus is not heated by the high frequency radiation.

A second magnet 14 is positioned outside the wave guide 1 in spaced opposed relation with the first magnet to form a magnetic coupling, and the second magnet 14 is mounted on the shaft of a motor 13 by means of a holder 11 and a pin 12. The space between the second magnet 14 and the wave guide 1 is set by a motor mounting means (not shown).

The magnet 10 preferably has a pointed tip 10' at the upper end thereof as shown in the drawing, which is in contact with the wave guide 1. The end of the inner end 4' of the antenna which is within the wave guide is engaged with the end of the sleeve bearing 8' which is within the wave guide, the flange **4*a* being held in sliding engagement with the end of the sleeve bearing when the pointed tip 10' of the magnet 10 contacts the wave guide so as to hold the inner end 4' within the sleeve bearing 8'. The pointed tip rotates in contact with the wave guide during rotation of the magnetic coupling to stablize the position of the antenna 5' in the sleeve bearing 8'. Results of experiments have revealed that in the structure of the invention the minimum possible spacing between the antenna 5' and the wave guide 1** which does not cause a spark is approximately 3 mms. The structure of the invention makes it possible to achieve such dimensional requirements. The structure of the present invention has the following advantages.

1. Since the rotatable antenna is not mechanically connected directly to the motor shaft for transmitting a driving force there is no need for a laborious aligning operation, thus simplifying the manufacturing process. In addition, stable and smooth rotation of the antenna is ensured because the possibility that the antenna deviates from the proper alignment is avoided. The absence of holes through the wall of the wave guide makes is unnecessary to provide means for keeping radiation from leaking through such holes. This is particularly beneficial in the case of microcomputer controlled electronic ranges wherein even a minor amount of radiation leakage causes trouble in the control operation.

2. In electronic ranges with an electric resistance heater, little or no heat escapes from the wall of the wave guide because of the absence of holes therein, ensuring a high degree of heating efficiency.

3. Similarly, in electronic ranges with electric resistance heaters, because the motor shaft is not mechanically connected directly to the antenna, there is a thermally insulating layer of air between the shaft and the antenna. There is thus no need for a thermally insulated motor or for providing heat insulation or cooling means and, hence, a complex and expensive structure can be avoided.

4. Since the first magnet is enclosed in the antenna, no special shield means is required, thus leading to savings in components and cost.

What is claimed is:

1. A microwave heating apparatus comprising:

a heating chamber; a high frequency oscillator; a wave guide between said oscillator and said chamber for leading electric radiation from said oscillator to said chamber and having a wall which is on the side of said wave guide closest to said chamber; a rotatable antenna electromagnetically coupling said wave guide with said heating chamber for distributing high frequency radiation in said chamber, said wave guide being made of a non-magnetic material and said rotatable antenna being made of a non-magnetic hollow tubular material, a sleeve bearing member having a flange portion attached to said wall and a sleeve portion integral with said flange and extending into said wave guide perpendicular to said wall, said rotatable antenna having an inner end portion extending into said sleeve portion of said wave guide and rotatably mounted therein and having an outwardly extending flange on the inner end of said inner end portion rotatably bearing against the inner end of said sleeve portion; a first magnet mounted within the hollow inner end portion of said rotatable antenna; and an antenna drive means outside said wave guide and in spaced opposed relation to said first magnet and forming a magnetic coupling therewith for rotating said antenna when said antenna drive means is operated.

2. A microwave oven as claimed in claim 1 in which said first magnet has a pointed tip thereon engaging the wall of the wave guide between said first and second magnets.

* * * * *